US005225284A

United States Patent [19]

Tusch

[11] Patent Number: 5,225,284

[45] Date of Patent: Jul. 6, 1993

[54] ABSORBERS

[75] Inventor: Klaus N. Tusch, London, England

[73] Assignee: Colebrand Limited, London, England

[21] Appl. No.: 603,240

[22] Filed: Oct. 25, 1990

[30] Foreign Application Priority Data

Oct. 26, 1989 [GB] United Kingdom ..... 8924084
Sep. 27, 1990 [GB] United Kingdom ..... 9021027

[51] Int. Cl.[5] ..... B21D 39/00

[52] U.S. Cl. ..... 428/409; 428/408; 428/418; 428/338

[58] Field of Search ..... 428/338; 342/18, 689, 342/408, 409, 418

[56] References Cited

U.S. PATENT DOCUMENTS

| | | | |
|---|---|---|---|
| 3,568,196 | 2/1969 | Bayrd et al. | 343/18 |
| 3,721,982 | 3/1973 | Wesch | 343/18 |
| 3,887,920 | 6/1975 | Wright et al. | 343/18 |
| 3,938,152 | 2/1976 | Grimes et al. | 343/18 |
| 4,006,479 | 2/1977 | LaCombe | 343/18 |
| 4,012,738 | 3/1977 | Wright | 343/18 |
| 4,024,318 | 5/1977 | Forster et al. | 428/519 |
| 4,038,660 | 7/1977 | Connolly et al. | 343/18 |
| 4,084,161 | 4/1978 | Manning et al. | 343/18 |
| 4,170,010 | 10/1979 | Reed | 343/18 |
| 4,173,018 | 10/1979 | Dawson et al. | 343/18 |
| 4,386,354 | 5/1983 | Watson | 343/18 |
| 4,480,256 | 10/1984 | Wren | 343/909 |
| 4,522,890 | 6/1985 | Volkers et al. | 108/264 |
| 4,814,546 | 3/1989 | Whitney et al. | 343/18 |
| 4,862,174 | 8/1989 | Natio et al. | 342/1 |

FOREIGN PATENT DOCUMENTS

| | | |
|---|---|---|
| 1074892 | 8/1957 | United Kingdom . |
| 1074893 | 8/1957 | United Kingdom . |
| 1074894 | 8/1957 | United Kingdom . |
| 1074851 | 11/1959 | United Kingdom . |
| 1074971 | 7/1967 | United Kingdom . |
| 1152431 | 5/1969 | United Kingdom . |
| 1258943 | 12/1971 | United Kingdom . |
| 1450791 | 9/1976 | United Kingdom . |
| 2062358 | 5/1981 | United Kingdom . |
| 2117569 | 10/1983 | United Kingdom . |
| 2163296 | 2/1986 | United Kingdom . |

OTHER PUBLICATIONS

HF Abschirmungen "Schafft Durchblick", Elektrotechniks 68 (Dec. 1986) No. 21/22, pp. 43–44.

Fertigungstechnik, "Metallbeschictung von Kunststoffgehäusen" Dipl.-Ing. Peter Scheyrer, Electronik vol. 32 (1983) No. 10, pp. 93–96.

*Primary Examiner*—Patrick J. Ryan
*Assistant Examiner*—R. C. Weisberger
*Attorney, Agent, or Firm*—Oliff & Berridge

[57] ABSTRACT

The invention relates to an absorber of incident electromagnetic radiation in the microwave band, comprising a metal reflector supporting seriatim a sheet of plastic material permeable to electromagnetic energy, an electrically conductive sheet in the form of a plastic layer on which is deposited an electrical conductor, and a further sheet of material permeable to electromagnetic radiation.

8 Claims, 2 Drawing Sheets

ABSORBERS

BACKGROUND OF THE INVENTION

The invention relates to absorbers, particularly absorbers for electromagnetic radiation, particularly such radiation at microwave frequencies.

It is often of advantage to be able to treat incident microwave energy in such a way that it is not reflected back to source. However, such energy is not readily absorbed, and can accordingly be reflected to source, so indicating the whereabouts of a body on which it is incident.

SUMMARY OF THE INVENTION

It is accordingly an object of the invention to seek to mitigate this disadvantage.

According to the invention there is provided an absorber of incident electromagnetic energy, comprising a first member adapted for mounting on a substrate and a second member which is an electrically conductive member, carried by the first member.

Preferably, there may be a plurality of electrically conductive members in the absorber. This provides an improved absorber.

The members may be spaced apart by material which is permeable to electromagnetic energy.

The members and material may respectively comprise films or sheets which are assembled to provide a body in the form of a laminate.

The or each member may comprise a conductive film or sheet of an electrically non-conductive carrier and a conductive layer thereon.

The or each carrier may comprise a plastics film on which is deposited a vaporized electrically conductive metallic coating, preferably of aluminum.

The non-conductive sheets may comprise plastics which are opaque, translucent or transparent.

The body may comprise a base member, preferably a sheet or plate of reflective material such as metal.

The electrically conductive member may act as a reflector of the electromagnetic energy which reaches it. All the other layers act as absorbers; they absorb the energy as it travels towards the reflector and they absorb more of it as it travels away from the reflector. The adjustment of layer thickness and relative conductivities enables the best total absorption to be achieved in the waveband of interest.

The embodiment of the invention described above is non-symmetric, and so will only absorb energy incident from one side. Energy incident from the other side may still be reflected. In order to overcome this problem, a symmetric arrangement may be provided, with an inner, preferably central, electrically conductive layer, thinner conducting layers on either side of the central layer and non-conductive spacing layers therebetween. There may be further non-conductive layers on the exterior of the thinner conductive layer for protection. As before, the layers may be laminated.

With a symmetrical arrangement in a panel, electromagnetic energy incident from either side of the panel may be absorbed and the panel becomes invisible to electromagnetic radiation sensors. The optical absorption can still be minimised by keeping all the layers as thin and transparent as possible.

BRIEF DESCRIPTION OF THE DRAWINGS

Absorbers embodying the invention, and results obtained using same, are hereinafter described by way of example, with reference to the accompanying drawings.

DESCRIPTION OF PREFERRED EMBODIMENTS

Figure 1A:
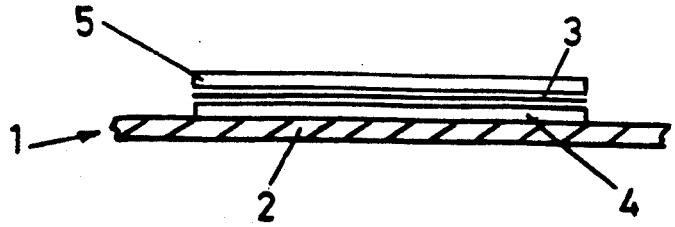
FIG. 1*a* is a schematic vertical sectional view through an absorber according to the invention.

Referring to the drawings, FIG. 1*a* shows an absorber 1 for incident electromagnetic energy in the microwave band, comprising a body adapted for mounting on a substrate by a first member in the form of a reflector 2 in the form of a metal sheet or plate, and a second member in the form of an electrically conductive member 3. The member 3 is a very thin conductive layer or film of plastic on one surface of which is deposited a conductive layer of vaporised aluminum. The coating is extremely thin and is therefore transparent. In the embodiment, the reflector 2 is a base of the absorber.

The conductive layer or film 3 is mounted or placed between two members 4 and 5, which are permeable to electromagnetic energy, in the form of clear acrylic plastic sheets.

The body 1 is adapted by the metal sheet 2 for mounting on a substrate, and comprises a laminate. The thicknesses of the acrylic sheets 4, 5 and the conductivity of the aluminum layer or sheet 2 are selected for optimum performance.

In a modification, there may be a plurality of conductive layers 3, which are spaced apart and supported on sheets 4, 5 of material permeable to electromagnetic radiation such as the acrylic sheets shown in FIG. 1*a*. In this modification, the absorber 1 is again a laminate.

Figure 1B:
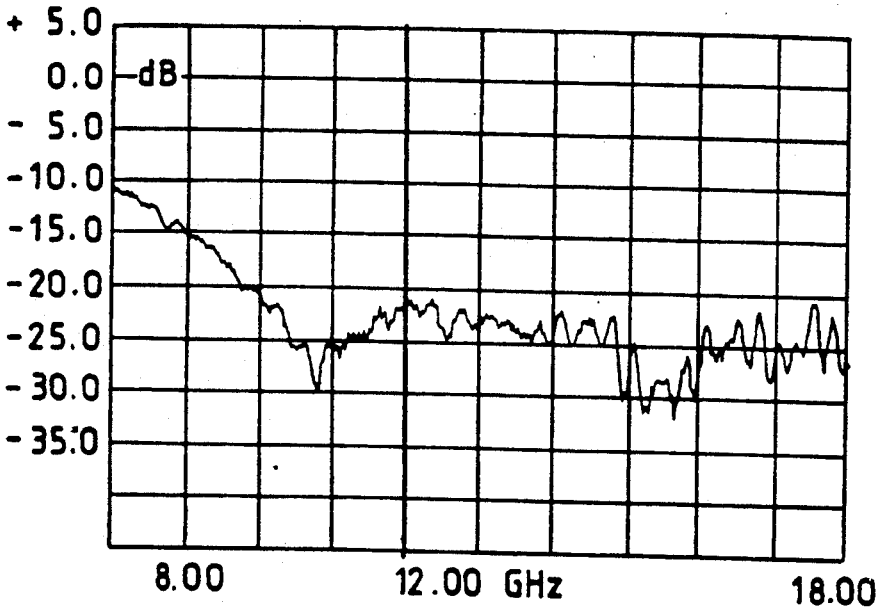
FIGS. 1*b* and 1*c* show respectively graphs showing use of the absorber of FIG. 1*a*, and a second embodiment of absorber (not shown) according to the invention.

Referring to the graphs, FIG. 1*b* is a graph showing the measured absorption characteristics of an absorber 1 like that of FIG. 1*a*. In this test the reflector plate 2 was an aluminum sheet.

The thicknesses of the sheets 4, 5 were adjusted to provide the best absorption levels over the frequency band from 8–18 GHz, that is microwave frequencies.

The curve shows that absorption levels of −20 dB (1% reflected power) have been obtained over most of the frequency band.

Figure 1C:
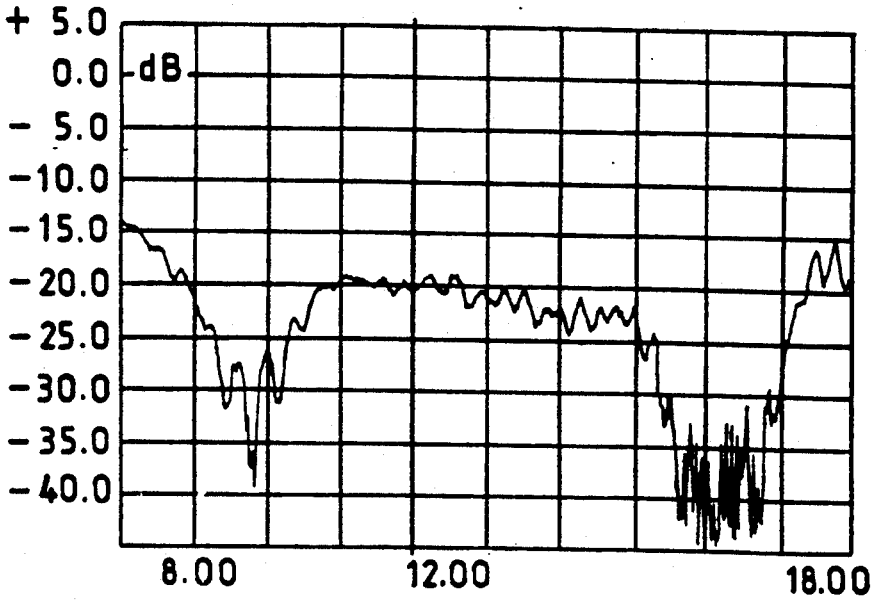

The effect of replacing the opaque aluminum reflector 2 by a second transparent layer 3 also made from a vaporized metallic film is shown in FIG. 1*c*. The metallic coating on this film was thicker and hence reflective to microwave energy whilst still having a high level of optical transparency. It is seen that a high level of microwave absorption of approximately −20 dB has been obtained over the whole of microwave band.

Use of a transparent reflector means that material is entirely transparent and the optical transmission in the case of the experimental material was reduced by about 60%.

Figure 2:
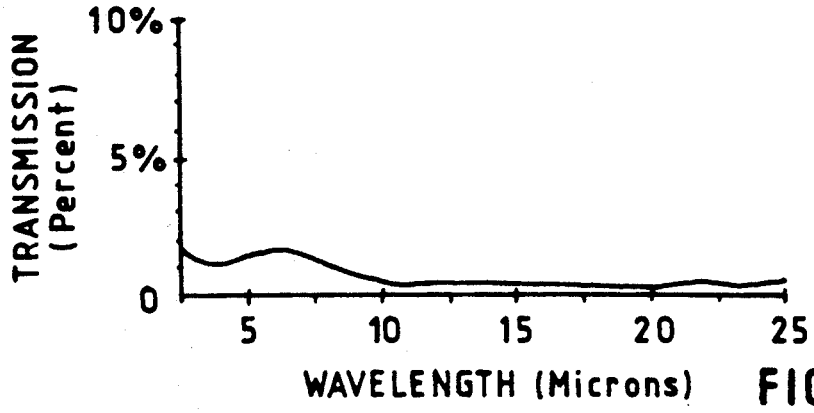
FIG. 2 shows graphically an infra-red transmission.

The transmission characteristics of the absorber used in FIG. 1*b* were measured on a IR Photospectrometer and are shown in FIG. 2. These measurements cover a wide IR waveband of 2.5 to 25 microns. It can be seen that the transmission through the test sheet is never greater than 2%. This indicates a high degree of reflectivity over the whole of this band even when absorption is taken into account. The absorption is based on losses produced from multiple reflections from one or more thin conductive films.

Application to transparent materials can thus produce highly efficient microwave absorbers whilst retaining good optical properties.

Figure 3:
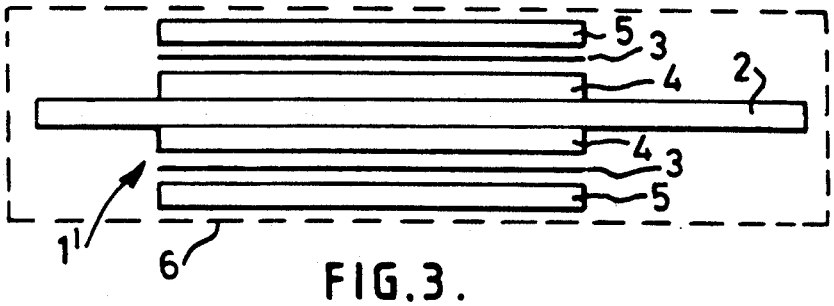
FIG. 3 shows a symmetrical panel according to the invention which has equal absorbtion properties for electromagnetic radiation incident from either side.

Referring now to FIG. 3, in which like parts are referred to by like reference numerals, there is shown therein an absorber 1' which is a symmetric absorber, in other words there is a reflector 2 which is placed centrally of the absorber with members 3, 4 and 5 on either side thereof, the members 4 and 5, as on the FIG. 1 embodiment, each comprising a sheet of clear acrylic plastic permeable to electromagnetic energy and the member 3 being between the sheets 4 and 5 and comprising a very thin conductive layer or film of plastic on one surface of which is deposited a conductive layer of vaporized aluminum of such a thickness as to be effectively transparent. The absorber of FIG. 3 functions in the same way as that of FIG. 1.

It will be understood that modifications may be made. For example, the aluminized sheet, or Bayfoil, may be replaced in FIGS. 1*a* and 3 by a sputter deposited stainless steel as in FIG. 4 (see below). Moreover, the non-conductive layer 2 may be replaced by non-conductive plastic foam, which provides a relatively light yet rigid absorber; the plastic sheets may be of polyvinyl chloride (pvc), polyester, or polyester fabric. The whole absorber may be enclosed in a sheath or envelope of fabric, such as polyester fabric, as shown at 6 in dashed lines in FIG. 3 forming a holder for the first and second members.

Figure 4:
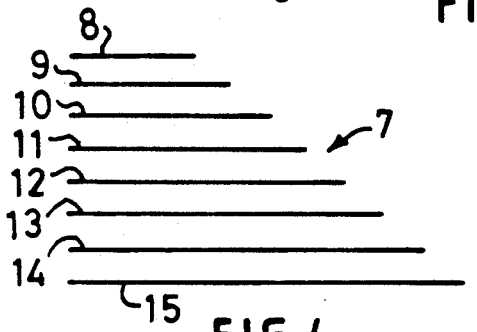
FIG. 4 is a schematic representation of a further embodiment of the absorber according to the invention.
Figure 5:
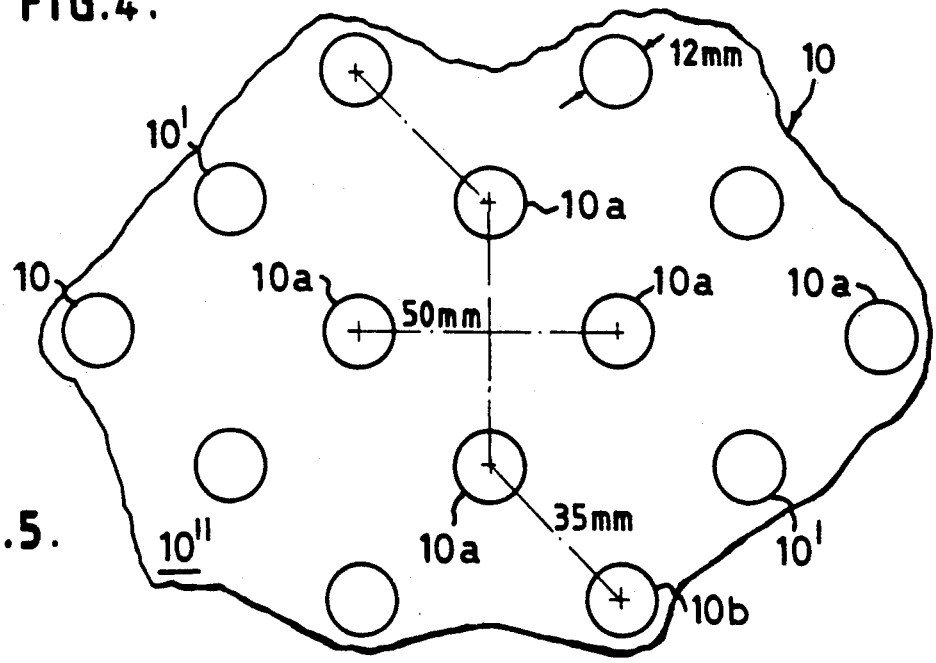
FIG. 5 is an enlarged schematic representation of a member incorporated in the absorber of FIG. 4.

Referring now to the embodiment 7 of FIGS. 4 and 5, the absorber shown schematically in FIG. 4 is a laminate of an outer cover comprising a sheet 8 of polyvinyl chloride (pvc), a top (as viewed) or inner sheet of pvc 9, a member 10 in the form of a sheet of foam material which is perforated with through perforations 10' which are circular, of 12 mm diameter and which form a lattice or array 10" in which there is a centre-to-centre spacing of 50 mm between adjacent orthogonally disposed apertures 10*a* and a spacing of 35 mm, centre-to-centre, between diagonally disposed adjacent apertures 10*a*, 10*b* (see FIG. 5). The foam 10 has a nominal thickness of 2.8 mm. The perforations 10' assist in dissipation of incident electromagnetic energy in the microwave band, which energy is dissipated by the pores of the foam and absorbed by the perforations acting as 'wells' or 'sinks' in which the energy becomes absorbed.

The perforations disrupt the electrical resistance, and the foam with the other layers or sheets of the laminate provides an absorber which is harmonized electrically.

The foam sheet 10 lies on a conductor in the form of a sheet 11 of material such as that sold under the trade name BAYFOIL, having a resistivity of approximately 350 ohms.

Both foam sheets may be CN-120 foam, which is a closed cell conductive polyethylene foam.

The conductor 11 in turn lies on a further sheet 12 of foam, in this case a solid or unperforated, foam, of nominal thickness about 2.2 mm.

The foam sheet 12 in turn lies on a further sheet 13 of plastics material, preferably pvc and this in turn lies on a reflector sheet 14 such as an aluminized sheet of plastic, or a sheet of plastic with a sputter deposited stainless steel.

The reflector 14 is then covered by a pvc outer cover or sheet 15. The outer covers or sheaths 8 and 15 can be secured together by any suitable means such as heat welding to form an envelope as shown in dashed lines in FIG. 3 which surrounds or encloses the whole absorber.

The whole absorber 7 thus comprises a laminate of sheets 9–14, which absorber acts in a similar manner to that shown in FIGS. 1*a* and 3 in absorbing incident microwave energy in the microwave band, as well as acting as a reflector of heat energy so that the infra-red energy cannot 'escape', and be detected, from a substrate to which the absorber is applied.

In addition the materials have a high reflectivity in the infra-red wavebands. This would enable them to be used both for shielding or deflection of infra-red energy. This property might be important for military uses. Materials with this combination of features offer a very wide range of application particularly in the military field.

Designers also have an extra degree of freedom in that in general by use of the invention they could provide the materials they wish to use for structural purposes etc., with the added advantage of microwave absorption.

A method of making the absorber can be used to convert sheets of many different types of plastic or other materials that allow microwaves to pass through them into efficient wide band absorbers.

A feature of the method is that it can be applied to sheets of materials that are optically transparent. The sheets then acquire the properties of high absorption of microwaves whilst their optical performance is only slightly impaired.

At infra-red wavelengths the materials are highly reflective and this feature provides secondary advantages as to heat protection.

I claim:

1. An absorber for incident electromagnetic energy, comprising:
   (i) a first member comprising a reflector which is opaque to incident electromagnetic energy; and
   (ii) two second members carried by the first member and each comprising an electrically conductive member spaced from the first member by a sheet of material which is permeable to incident electromagnetic energy,
   said first member being intermediate said second members.

2. An absorber as defined in claim 1, wherein the electrically conductive member comprises an electrically non-conductive carrier with a conductive layer applied thereto.

3. An absorber as defined in claim 2, wherein the conductive layer comprises aluminum applied by vapour deposition.

4. An absorber as defined in claim 2, wherein the conductive layer comprises stainless steel applied by sputter deposition.

5. An absorber as defined in claim 1, wherein the first member is centrally disposed in a laminate comprising said first member with said second members on either side thereof.

6. An absorber as defined in claim 1, wherein each second member comprises a plastic foam material.

7. An absorber as defined in claim 1, wherein each second member comprises a polyester fabric material.

8. An absorber as defined in claim 1, further comprising a sheath of flexible material forming a holder for holding the first and second members together.

* * * * *